US005125562A

United States Patent [19]

Bendel

[11] Patent Number: 5,125,562

[45] Date of Patent: Jun. 30, 1992

[54] MULTI-PANEL MAILER

[76] Inventor: Bruce Bendel, 1545 White Oak Rd., Lake Forest, Ill. 60045

[21] Appl. No.: 569,839

[22] Filed: Aug. 20, 1990

[51] Int. Cl.[5] ..... B65D 27/10

[52] U.S. Cl. ..... 229/69; 229/301; 229/316

[58] Field of Search ..... 229/69, 71, 73, 92.1, 229/92.3, 301, 313, 316; 400/583.3

[56] References Cited

U.S. PATENT DOCUMENTS

| | | | |
|---|---|---|---|
| 893,202 | 7/1908 | Shaw . | |
| 970,659 | 9/1910 | Stewart . | |
| 1,518,183 | 7/1923 | Dailey . | |
| 1,561,454 | 11/1925 | Ashby | 229/73 |
| 1,567,875 | 12/1925 | Swanson . | |
| 1,583,867 | 5/1926 | Benedict . | |
| 1,944,853 | 1/1934 | Unger . | |
| 1,995,183 | 3/1935 | Kovnat | 229/73 |
| 2,116,230 | 5/1938 | Berkowitz . | |
| 2,773,638 | 11/1947 | Krohn . | |
| 3,126,148 | 3/1964 | Hanson . | |
| 3,225,952 | 6/1966 | Black . | |
| 3,228,586 | 1/1966 | Hayes . | |
| 3,229,893 | 1/1966 | Stein . | |
| 3,319,871 | 5/1967 | Hayes . | |
| 3,507,519 | 4/1970 | McNabb . | |
| 3,557,519 | 1/1971 | Lyon . | |
| 3,658,163 | 4/1972 | Sniderman | 400/583.3 |
| 3,858,792 | 1/1975 | Volkert . | |
| 3,977,597 | 8/1976 | Wise . | |
| 4,025,025 | 5/1977 | Bartel et al. | 400/583.3 |
| 4,051,995 | 10/1977 | Wieman | 229/69 |
| 4,255,064 | 3/1981 | Kelly | 400/583.3 |
| 4,552,065 | 11/1985 | Billington et al. | 400/583.3 |
| 4,575,121 | 3/1986 | Conti . | |
| 4,589,590 | 5/1986 | McGuire et al. | 229/92.8 |
| 4,598,860 | 7/1986 | Pennock | 229/71 |
| 4,625,909 | 12/1986 | Ferrando . | |
| 4,896,823 | 1/1990 | Taylor | 229/69 |
| 4,955,526 | 9/1990 | Haase et al. | 229/69 |
| 5,000,373 | 3/1991 | Schmidt | 229/69 |
| 5,039,652 | 8/1991 | Doll et al. | 229/68 R |

FOREIGN PATENT DOCUMENTS

| | | | |
|---|---|---|---|
| 799824 | 11/1968 | Canada | 229/92.1 |

OTHER PUBLICATIONS

Illinois Secretary of State describes a construction exemplary of a single ply two-way envelope.

Infoseal mailer describes a continuous two-way sheet mailer having four panels separated by three transverse foldlines.

Infoseal one-way continuous mailer has three panels separated by two foldlines.

*Primary Examiner*—Stephen Marcus
*Assistant Examiner*—Christopher J. McDonald
*Attorney, Agent, or Firm*—Lockwood, Alex, Fitzgibbon & Cummings

[57] ABSTRACT

A multi-panel mailer assembly includes a single sheet having multiple adjoining panels separated by transverse fold lines. The mailer assembly is folded into an outgoing mailer unit along the transverse fold lines in an alternating or "fan fold" arrangement. First and second bands of adhesive secure the mailer unit together such that its information panels are contained between a mailer cover and mailer back panel.

28 Claims, 2 Drawing Sheets

MULTI-PANEL MAILER

The present invention relates generally to an improved mailer and, more particularly, to a single sheet, multi-panel mailer assembly having a plurality of information panels disposed between a front and rear mailer panel.

Various types of mailers are widely known in the art and are companies used by many, such as billing authorities, for mailing billing information to customers. Often many customers of billing authorities do not have consistently equal billing for each billing period, and hence, the billing information sent out can vary, by customer, from billing period to billing period.

Billing mailers which have a fixed billing information area cannot handle such erratic billing. When the customer billing information exceeds the available area for such information on a standard mailer, the company must either defer the additional billing until the next billing period or send out a second mailer, which effectively multiplies the cost of billing.

Additionally, it is desirable to have the billing information remain enclosed in the mailer and secured from outside view. Mailers which contain an internal outgoing envelope accomplish this requirement, but single sheet mailers often require that a portion of the billing information be exposed.

The present invention is directed to a multi-panel mailer which overcomes these shortcomings. A multi-panel mailer incorporating the principles of the present invention, can accommodate any desired number of internal information panels required to complete the billing process. The information panels are securely held between a cover and rear panel so that the billing information is not exposed.

The present invention provides a multi-panel mailer formed from a single sheet of paper which is divided into a plurality of distinct panels by transverse fold lines which extend between the marginal edges thereof. The multi-panel mailer can be separated from a continuous feed of paper which is fed into a computer printer for printing of the billing information. After printing, the individual mailer units are assembled in a "fanfold" arrangement wherein individual adjoining panels are folded upon each other along a series of transverse fold lines in an adjacent overlying relationship. Adhesive means which has been deposited on portions of individual alternating panels holds the mailer together. The mailer may be provided with or without a return envelope.

Accordingly, it is a general object of the present invention to provide a multi-panel mailer assembled from a single sheet which is adapted to be computer printed.

Another objection of the present invention is to provide a mailer assembly having multiple information-bearing panels, which information panels are enclosed between opposing cover and rear panels of the mailer assembly.

A further object of the present invention is to provide a multi-panel mailer which can have information printed on both sides of the information panels.

Yet another object of the present invention is to provide a single sheet, multi-panel expandable mailer wherein the mailer sheet is divided into individual adjoining mailer panels by a plurality of transverse fold lines and wherein the mailer is assembled by folding adjoining panels upon themselves in adjacent overlying relationship.

It is still another object of the present invention to provide a series of connected mailer units wherein each mailer unit has a plurality of adjoining mailer panels separated by transverse fold lines and wherein the first and last panels of each mailer unit contain means for indicating the beginning and end of each unit.

These and other objects, features, and advantages of the present invention will be clearly understood from the following detailed description, taken in conjunction with the accompanying drawings in which like reference numerals refer to like parts.

BRIEF DESCRIPTION OF THE DRAWINGS

In the course of this description, reference will be made to the attached drawings, in which.

DETAILED DESCRIPTION OF THE PREFERRED EMBODIMENTS

Figure 1:
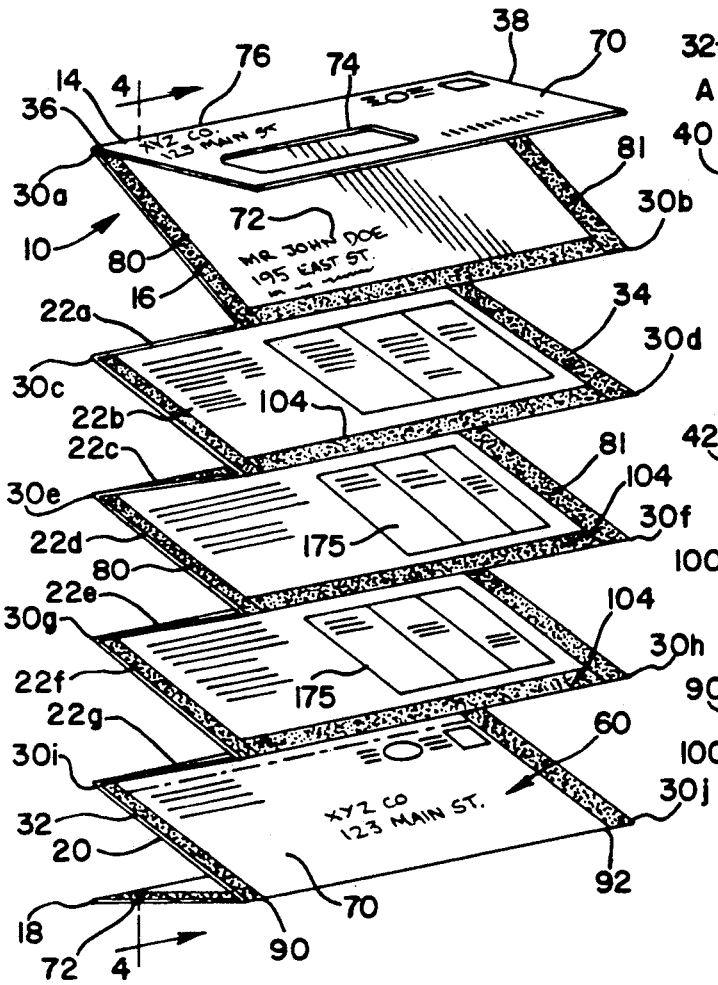
FIG. 1 is a perspective view of one embodiment of a mailer constructed in accordance with the principles of the present invention.
Figure 4:
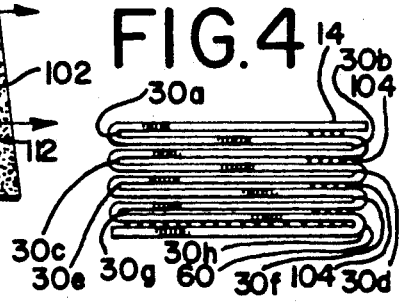
FIG. 4. is an elevational view of an assembled mailer of FIG. 1 taken along lines 4—4.
Figure 5:
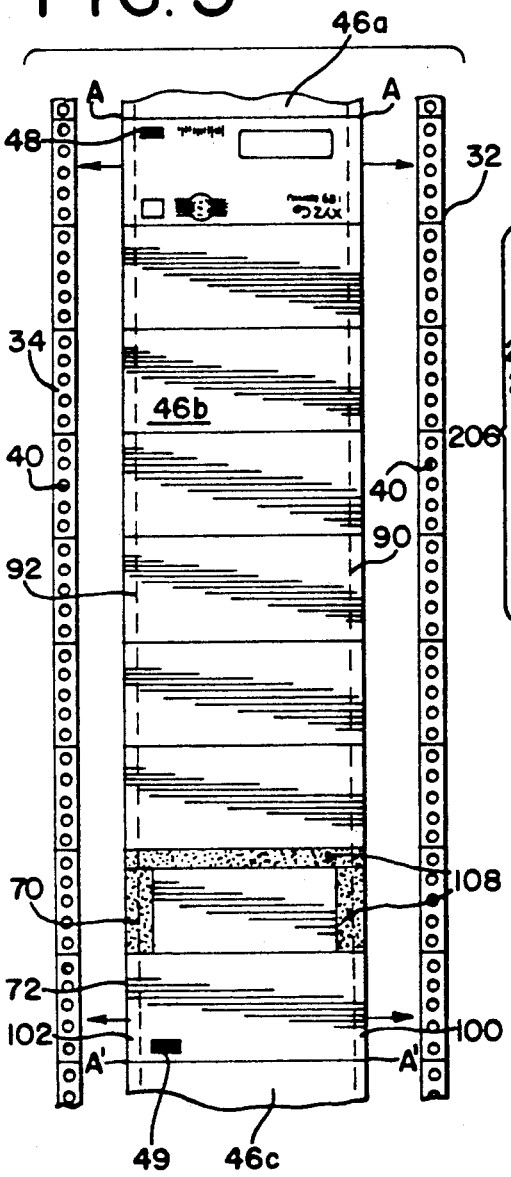
FIG. 5 is a back plan view of the connected series of mailer units shown in FIG. 2.

A first embodiment of a multi-panel mailer 10 constructed in accordance with the principles of the present invention is shown in FIG. 1 as having a single continuous base sheet 12 having a plurality of distinct adjoining panels including a mailer cover or front panel 14, an address panel 16, a back or rear panel 18 and a plurality of information panels 22*a–g* extending between the front panel 14 and the rear panel 18. The individual panels are separated and interconnected on the base sheet 12 by a plurality of generally equally spaced-apart and generally parallel transverse fold lines 30*a–j*. When folded along the transverse fold line 30*a–j* adjoining panels are disposed in an adjacent overlying relationship (FIG. 4).

The mailer base sheet 12 is adapted to be used in a printing and assembling machine that utilizes continuous sheet forms and thus may be provided with removable feed strips 32, 34 disposed along the marginal edges 36–38 of each mailer panel. The removable feed strips have a series of control holes 40 which are positioned to engage pins used in conveying the mailer 10 from feed rolls (not shown) into a computer printer and assembly mechanism. The removable feed strips 32, 34 are defined by two spaced-apart longitudinal lines of potential severance 42, 44, such as perforations and are thus adapted to be removed once printing and assembly of the mailer takes place.

Turning now to the embodiment illustrated in FIG. 1, the mailer front panel 14 includes an outgoing mailer face portion 70 which may either contain the customer address 72 or a die-cut opening 74 which allows the customer address 72, when printed directly on the address panel 16, such as by an impact printer, to appear and be read through the front panel 14. A return address 76 may also be provided on the front panel 14. Mailer information, such as billing information 175 may be printed on the "internal" information mailer panels 22*a-g*, which as explained below, is held between the front and rear mailer panels 14, 18.

Figure 2:
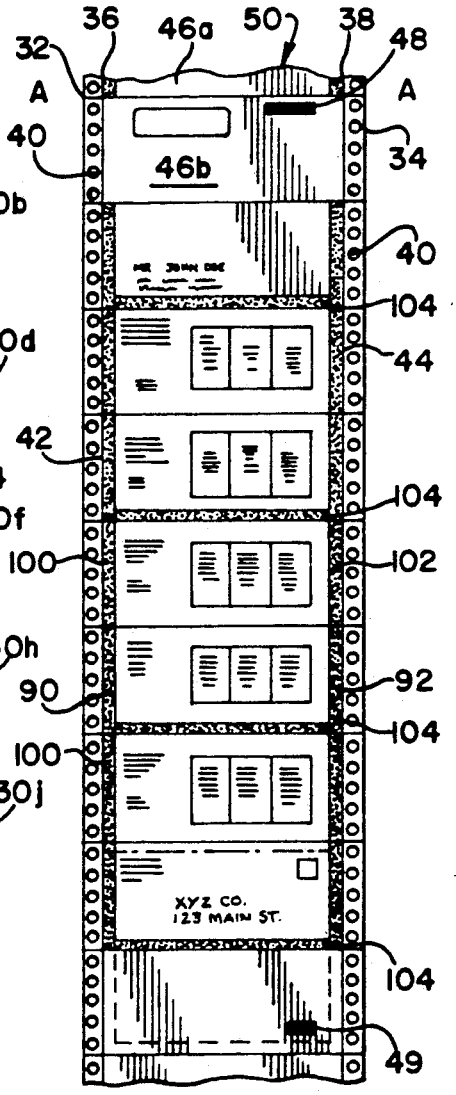
FIG. 2 is a plan view of another embodiment of the present invention constructed in accordance with the principles of the present invention showing a connected series of mailer units.
Figure 7:
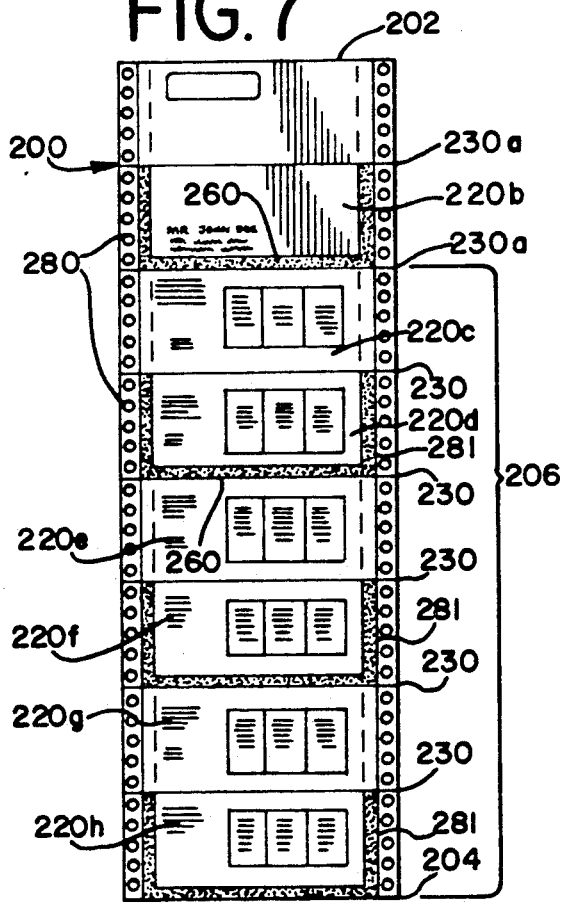

To assemble the outgoing mailer, the continuous base sheet 12 is folded along the parallel transverse fold lines 30*a*-30*j* in an alternating or "fanfold" fashion wherein successive fold lines are folded in opposite directions. This "fanfold" format permits adjoining mailer panels to adjacently overlie each other as best shown in FIG. 4 such that a one-piece outgoing mailer is formed. The outgoing mailer format is maintained by means of a series of first adhesive bands 80, 81 which are longitudinally disposed either on alternating adjoining panels along and within the continuous sheet marginal edges 36, 38 as shown in FIG. 7 or longitudinally disposed along the entire marginal edges as shown in FIG. 2. The first adhesive bands 80, 81 include a permanent adhesive and one of a width sufficient so as to enable the mailer 10 to survive the rigors of printing, assembling, handling and mailing. Alternatively, the first adhesive bands can include a relatively non-permanent adhesive having a relatively wide thickness so that the mailer remains in its assembled format throughout the mailing process.

A pair of generally parallel and spaced-apart longitudinal lines of weakening 90, 92, such as perforations, are disposed on the mailer base sheet 12, generally along the mailer opposite marginal edges 36, 38 proximate to and interior of the marginal adhesive bands 80, 81. These lines of weakening 90 92 define a pair of opposing mailer discard portions or tear strips 100, 102 (FIG. 3) which the mailer recipient removes upon receipt so as to gain access to the information contained within the mailer.

In addition to the first adhesive bands 80, 81, each alternating mailer panel may include a transverse second adhesive band, in the form of line 104 disposed generally parallel and proximate to the transverse fold lines 30*a*-30*j*. This second adhesive band 104 assists in ensuring that the mailer does not open during mailing and reveal the contents thereof to an outsider. In this regard, the second adhesive bands 104 may utilize either a permanent or non-permanent adhesive. Where a non-permanent or easily removable adhesive having a relatively low adhesive strength is used, the second adhesive lines 104 may be relatively wide so that the second adhesive holds the mailer together but which allows separation of adjacent folded panels without tearing or otherwise defacing one or both of the overlying panels. Alternatively, where the second adhesive bands 104 utilize a relatively permanent adhesive, the second adhesive lines 104 have a width substantially less than that of the first adhesive bands 80, 81 so as to permit the opening of the mailer in the manner described above without damage to the panels thereof.

The mailer base sheet 12 may or may not include an integral return envelope 60. In the case of the latter, wherein the mailer has a "two-way" format, i.e., having an integral return envelope, as illustrated in FIGS. 1 and 2, it may include a front panel 14, an address panel 16, various information panels 22*a* to 22*g* and a two-piece return envelope 60. In such a construction, the mailer return envelope 60 includes two additional panels 70, 72 wherein one panel 72 includes a series of sufficiently wide third adhesive bands 108 disposed along opposite marginal edges 110, 112 thereof. These third adhesive bands 108 permit the two panels 70, 72 to be secured together to define a return envelope pocket 62 therebetween. The return envelope face panel 70 includes a return envelope face portion 64 having a business reply address 65, a business reply indicator bar code 66 and a return envelope flap portion 67. The business reply address 65 and bar code indicator 66 are positioned within the return envelope face portion 64 so as to be easily read by Postal Service optical character reader processing equipment. The return envelope face portion 64 is separated from the return envelope flap portion 67 by a transverse fold line 68. The return envelope flap portion 67 is secured to the mailer back panel 18 by the customer by means of a conventional adhesive strip 69 disposed on either the rear surface of the flap portion 67 or the mailer back panel 18. Preferably, when the mailer 10 is intended to have such a "two-way" format with an integral return envelope, the mailer has an odd number of panels.

Figure 6:
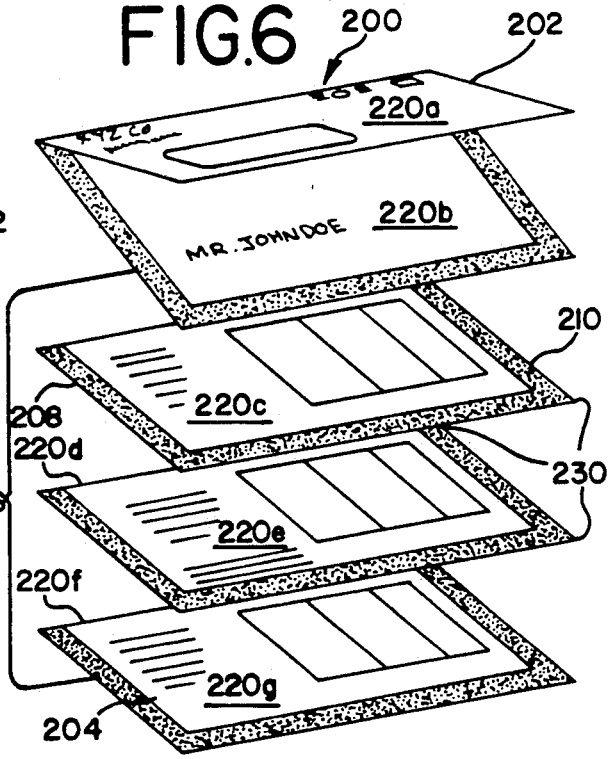
FIG. 6 is a perspective view of a third embodiment of a mailer constructed in accordance with the principles of the present invention; and, FIG. 7 is a plan view of the mailer of FIG. 6.

In contrast, as shown in the embodiment illustrated in FIGS. 6 and 7, when the mailer 200 is intended to have a "one-way" format with no integral return envelope, the mailer will have an even number of panels. The even number of panels permits the mailer information panels 206 to be secured between the respective front and rear panels 202, 204 thereof so that the information panels 206 cannot be accessed without removal of the opposing marginal tear strips 208, 210. Also, in this embodiment, the first adhesive bands 280, 281 are disposed on alternating mailer panels 220*b*, 220*d*, 220*f* and 220*h*. As shown in the other embodiments the alternating panels include, at their transverse edeges, proximate to the fold lines 230, the second adhesive bands 260 as described above.

Figure 3:
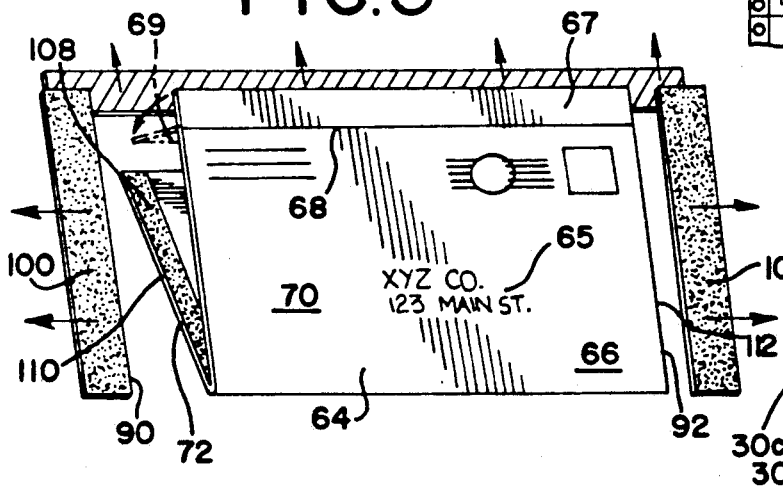
FIG. 3 is a fragmentary view of the mailer of FIG. 1 showing the details of the return envelope.

The present invention lends itself to be efficiently and easily produced in a continuous feed format. Referring now to FIGS. 2 and 3, a continuous sheet assembly 50 having an interconnected series of separable of mailer units 46*a*, 46*b*, 46*c* (FIG. 2) is illustrated. The mailer units 46*a*, 46*b*, 46*c* are provided with spaced-apart transverse lines of potential severance, such as perforations A, A' which extend transversely between the removable feed strips 32, 34 and which separate successive mailer units from each other.

Structually, each mailer unit 46*a*, 46*b*, 46*c* is identical to the others in the series as has been explained in greater detail above. To assist in the rapid printing and assembly of the units, each unit may include means for indicating the beginning and end of the unit such as indicating blocks 48, 49 which are adapted to be sensed by a sensing mechanism in either or both of the printer and assembler. The mailer units 46*a*, 46*b*, 46*c* can be preliminarily printed on both the top and bottom surfaces for advertising messages and then further printed with the customer billing information.

It will be appreciated that the embodiments of the present invention that have been discussed herein are merely illustrative of a few applications of the principles of the invention. Numerous modifications may be made by those skilled in the art without departing from the true spirit and scope of the invention.

I claim:

1. A one-piece, two-way mailer assembly for forming a multi-panel mailer unit, the mailer assembly including a base sheet, the mailer base sheet having a plurality of adjoining mailer panels defined thereon by a plurality of transverse spaced-apart fold lines, said mailer base sheet adapted to be folded about the transverse fold lines to position adjoining mailer panels in adjacent overlying relationship to form an outgoing mailer unit, said transverse fold lines being disposed within said mailer base sheet generally parallel to each other, the first panel of said mailer assembly forming a cover panel for said mailer unit, the last two panels of said mailer assembly forming a return envelope of said mailer unit, said mailer unit return envelope including a return envelope front panel and return envelope rear panel, one of the return envelope front and rear panels including a return envelope flap portion for sealing said return envelope, only alternating panels of said mailer assembly base sheet having first adhesive means disposed thereon at the marginal edges thereof for adhesively securing said mailer assembly panels together in said adjacent overlying relationship, the mailer assembly alternating panels further including second adhesive means disposed thereon for adhesively securing said mailer assembly panels together in a direction generally transverse to said first adhesive means, said alternating panel first and second adhesive means engaging adjacent panels of said mailer, said second adhesive means including a line of adhesive having a width substantially less than the width of said first adhesive means, said second adhesive means being a non-permanent adhesive.

2. The mailer assembly of claim 1, wherein said mailer assembly includes an odd number of mailer panels.

3. The mailer assembly of claim 1, wherein said base sheet first adhesive means includes a relatively wide band of permanent adhesive disposed within a portion disposed at the marginal edges of said base sheet.

4. The mailer assembly of claim 1, wherein said mailer assembly includes a plurality of information bearing panels disposed between said first panel and said return envelope.

5. The mailer assembly of claim 1, wherein said mailer base sheet includes two generally parallel lines of weakening disposed proximate to the marginal edges, the lines of weakening defining two mailer assembly opposing, marginal discard portions.

6. The mailer assembly of claim 1, wherein said mailer base sheet includes two generally parallel lines of weakening disposed proximate to the marginal edges of said mailer panels, said two lines of weakening being generally disposed interior of said base sheet first adhesive means, said base sheet first adhesive means including a relatively wide band of permanent adhesive.

7. The mailer assembly of claim 1, wherein said cover panel includes a die-cut designated address area thereon.

8. The mailer assembly of claim 1, wherein said cover panel includes a designated address area disposed in a preselected location, said designated address area preselected location conforming to postal specifications for optical character reading of mailer addresses.

9. The mailer assembly of claim 1, wherein said base sheet second adhesive means includes a non-permanent adhesive.

10. The mailer assembly of claim 1, wherein said first and last panel of said mailer unit includes sensor readable means thereon which indicates the beginning and end of said mailer unit.

11. The mailer assembly of claim 1, wherein said sensor readable means includes optical characters readable by an optical character reader.

12. An integral sheet, multi-panel mailer comprising a continuous sheet, the continuous sheet including a plurality of interconnected adjoining individual panels each of said individual panels being of substantially equal size, the mailer including a front panel, a first back panel and at least one intermediate panel disposed therebetween, the mailer further including a plurality of generally parallel transverse fold lines which define the transverse edges of said interconnected panels, said mailer front panel forming a front address face when said mailer is folded upon itself alone said transverse fold lines so that adjoining panels are adjacently disposed in overlying relationship, only alternating adjoining panels of said mailer including first adhesive means disposed along an information surface thereof for adhesively securing said mailer after folding said mailer along said transverse fold lines each of said mailer panels further including marginal lines of weakening disposed along the marginal edges thereof and proximate to said first adhesive means, said mailer further including second adhesive means disposed proximate to a transverse edge of alternating adjoining panels and on said information surface thereof.

13. The multi-panel mailer of claim 12, wherein said mailer includes a second back panel adjoining said back panel, one of said back panel and second back panel having third adhesive means disposed thereon proximate to and generally parallel to said first adhesive means, the third adhesive means securing said back panel and said second back panel together to define a return envelope having a return envelope pocket therebetween, said first and second back panels further including a discard portion detachably engaging said return envelope.

14. The multi-panel mailer of claim 12, wherein said base sheet includes control strip means disposed along the marginal edges of the interconnected panels, the control strip means being defined by a second line of weakening disposed interior of said control strip means.

15. The multi panel mailer of claim 12, wherein said mailer includes an odd number of interconnected mailer panels.

16. The multi-panel mailer of claim 12, wherein said mailer includes an even number of interconnected mailer panels.

17. The multi-panel mailer of claim 12, wherein each of said mailer panels includes marginal discard portions defined by third lines of weakening disposed interior of said first adhesive means.

18. The multi-panel mailer of claim 12, wherein said mailer second adhesive means includes lines of a non-permanent adhesive.

19. The multi-panel mailer of claim 12, wherein front panel and said back panel includes means for indicating the beginning and end of said mailer to a sensing mechanism.

20. The multi-panel mailer of claim 19, wherein said indicating means includes optical coding adapted to be read by an optical character reader.

21. A connected series of mailer units computer printable and thereafter separable into individual mailer units, each mailer unit comprising a multi-panel continuous sheet equipped with equally transverse spaced-apart lines of severance to provide said individual units, the continuous sheet including a plurality of multiple adjoining mailer unit panels, the panels of each mailer unit being defined by a plurality of generally equally spaced-apart fold lines disposed transversely within each mailer unit, first adhesive means disposed only on alternating panels of each mailer unit proximate to the marginal edges of said panels, the first panel of each said mailer unit including an outgoing mailer cover portion thereon, the last panel of said mailer unit including an outgoing mailer back portion thereon, said mailer unit including a plurality of information panels disposed between said mailer unit front and last panels, said transverse lines of folding permitting each mailer unit to be fanfolded about said transverse lines of folding into an outgoing mailer unit wherein said information panels are disposed between said mailer unit cover and back portions, said first adhesive means on each mailer unit maintaining the same in a folded condition for mailing, each of said mailer units including second adhesive means disposed along a transverse edge of alternating mailer unit panels, said first adhesive means including a relatively wide band of a permanent adhesive, the second adhesive means including lines of a non-permanent adhesive.

22. The series of mailer units of claim 21, wherein each of said mailer units includes an odd number of panels.

23. The series of mailer units of claim 21, wherein each of said mailer units includes an even number of panels.

24. The series of mailer units of claim 21, wherein each of said mailer units includes an odd number of panels, and each of said mailer unit last panels and second to last panels including third adhesive means, thereby forming a mailer unit return envelope with a return envelope pocket therebetween.

25. The series of mailer units of claim 21, wherein each of said mailer units includes control strip means disposed along at least one marginal edge thereof, said mailer units further including a longitudinal line of weakening disposed generally parallel to and interior of said control strip means.

26. The series of mailer units of claim 21, wherein each of said mailer units includes a pair of first longitudinal lines of weakening disposed on said mailer unit panels generally parallel to and interior of said first adhesive means, the first longitudinal lines of weakening defining opposing tear strips of said mailer.

27. The series of mailer units of claim 21, wherein said first adhesive means includes a relatively wide band of a permanent adhesive and said second adhesive means includes a line of a non-permanent adhesive, said second adhesive means having a width substantially less than said first adhesive means.

28. The series of mailer units of claim 21, wherein each mailer unit first and last panel includes means for indicating the start and end of said mailer unit, said indicating means being adapted to be sensed by a sensing means of a mailer unit assembly mechanism.

* * * * *